US007644664B2

(12) United States Patent
Nakao et al.

(10) Patent No.: US 7,644,664 B2
(45) Date of Patent: Jan. 12, 2010

(54) TRACK GUIDED VEHICLE SYSTEM

(75) Inventors: Takashi Nakao, Neyagawa (JP); Tamotsu Shiwaku, Kani (JP); Yoichi Nakamura, Nagaokakyo (JP); Isao Fukuda, Kameoka (JP); Ryosuke Tahara, Kyoto (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 1023 days.

(21) Appl. No.: 10/989,412

(22) Filed: Nov. 17, 2004

(65) Prior Publication Data

US 2005/0139114 A1 Jun. 30, 2005

(30) Foreign Application Priority Data

Dec. 26, 2003 (JP) ..... 2003-432430
Feb. 6, 2004 (JP) ..... 2004-030011
Apr. 8, 2004 (JP) ..... 2004-114424

(51) Int. Cl.
*B61B 12/02* (2006.01)

(52) U.S. Cl. ..... 104/243

(58) Field of Classification Search ..... 104/130.01, 104/130.04, 130.07, 242, 243, 130.09; 246/415 R
See application file for complete search history.

(56) References Cited

U.S. PATENT DOCUMENTS 4,275,660 A * 6/1981 Forster ..... 104/247
4,671,185 A * 6/1987 Anderson et al. ..... 104/130.07

(Continued)

FOREIGN PATENT DOCUMENTS

JP 48-005103 1/1973

(Continued)

OTHER PUBLICATIONS

Merriam-Webster's Colliegiate Dictionary 10$^{th}$ Ed. p. 163 definition of"cam".*

(Continued)

*Primary Examiner*—S. Joseph Morano
*Assistant Examiner*—Robert J McCarry, Jr.
(74) *Attorney, Agent, or Firm*—Westerman, Hattori, Daniels & Adrian, LLP

(57) ABSTRACT

Guide tracks 56, 56 projecting in a vertical direction are provided in a right and left of a running track 50 and left and right guide rollers 20, 21 are provided on a track guided vehicle and guided using inner surfaces of the left and right guide tracks. Branching rollers 22, 23 each comprising elevating and lowering means are provided in the right and left of the track guided vehicle and outside the right and left guide tracks. Thus, branching and rectilinear progression of the track guided vehicle is controlled by switching between a state where the branching rollers 22, 23 are elevated or lowered to guide the track guided vehicle using outer surfaces of the guide tracks 56, 56 and a state where the branching rollers 22, 23 do not contact with the outer surfaces. Whether the track guided vehicle runs straight or shifts to a branch line can be controlled by contacting one of the branching rollers 22, 23 with the outer surface of the corresponding guide tracks 56, 56, which guide the guide rollers 20, 21 in the section (rectilinear progression section 52) different from the branching portion 51.

4 Claims, 7 Drawing Sheets

U.S. PATENT DOCUMENTS

| | | | | |
|---|---|---|---|---|
| 5,277,124 | A * | 1/1994 | DiFonso et al. | 104/130.07 |
| 6,095,054 | A | 8/2000 | Kawano et al. | |
| 6,220,173 | B1 * | 4/2001 | Sauerwein | 104/130.01 |
| 6,308,636 | B1 * | 10/2001 | Collins et al. | 104/130.01 |

FOREIGN PATENT DOCUMENTS

| | | | |
|---|---|---|---|
| JP | 53-107018 | | 9/1978 |
| JP | H06-087436 | A | 3/1994 |
| JP | 07-40361 | | 7/1995 |
| JP | H07-229362 | A | 8/1995 |
| JP | 09-221023 | | 8/1997 |
| JP | 2001-071895 | | 3/2001 |
| JP | 2001-171513 | | 6/2001 |
| JP | 2002-087250 | A | 3/2002 |
| JP | 2002-160627 | A | 6/2002 |
| JP | 2003-146204 | A | 5/2003 |
| JP | 2003-212112 | | 7/2003 |
| JP | 2003-212112 | A | 7/2003 |

OTHER PUBLICATIONS

Microfilms of Japanese Utility Model Registration Application No. S56-028877 (Japanese Unexamined Utility Model Application Publication No. S57-142672).

Microfilms of Japanese Utility Model Registration Application No. S53-040352 (Japanese Unexamined Utility Model Application Publication No. S53-152311).

Microfilms of Japanese Utility Model Registration Application No. S55-000027 (Japanese Unexamined Utility Model Application Publication No. S56-102267)—JP,2003-212112,A.

JP,S53-107018,A; Sep. 18, 1978.

Notification of Reason(s) for Refusal of the Japanese Patent Applications No. 2004-030011 and No. 2004-114424, which are the applications based on the priority claim, from the Japanese Patent Office.

Microfilm of Japanese Utility Model Registration Application No. S53-041123 (Japanese Unexamined Utility Model Application Publication No. S53-152312).

CD-ROM of Japanese Utility Model Registration Application No. H05-070242 (Japanese Unexamined Utility Model Application Publication No. H07-040361).

* cited by examiner

TRACK GUIDED VEHICLE SYSTEM

FIELD OF THE INVENTION

The present invention relates to a system using a track guided vehicle that runs along a running track, and in particular, to branching control of a track guided vehicle.

BACKGROUND OF THE INVENTION

A track guided vehicle system uses track guided vehicles to transport articles in a clean room, in a general factory, hospital, or library, or outdoors. Branching is required to provided a complicated layout of running tracks. The Unexamined Japanese Patent Application Publication (Tokkai) No. 2003-212112 discloses branching control of a track guided vehicle system. In the Unexamined Japanese Patent Application Publication (Tokkai) No. 2003-212112, a branching portion of the running track is provided with paired guide grooves for rectilinear progression and for branching. Further, a track guided vehicle is provided with paired branching rollers corresponding to the guide grooves. The branching rollers can be extended to and withdrawn from a position where they are guided through the guide grooves and a position where they are free. Whether the track guided vehicle runs straight or shifts to a branch line is controlled by selecting the branching roller guided by the corresponding guide groove. Further, in the entire running track except for its branching portion, guide wheels are guided using a vertical portion of the running track. However, this track guided vehicle system requires the pair of guide grooves to be provided for the branching control. Consequently, the running track has a complicated shape.

It is an object of the present invention to provide a track guided vehicle system that can use a simple configuration to determine whether the track guided vehicle runs straight or shifts to a branch line.

An additional object of the invention is to allow the height position of branching rollers to be reliably controlled, thus ensuring that rectilinear progression and branching can be controlled.

An additional object of the invention is to prevent elevation and lowering of the branching rollers from interfering with guide rollers to eliminate the need to reduce speed in front of a branching portion and to allow a track guided vehicle to run stably through the branching portion at high speed either for rectilinear progression or for branching.

SUMMARY OF THE INVENTION

In a track guided vehicle system according to the present invention, guide tracks projecting in a vertical direction are provided in a right and left of a running track and left and right guide rollers are provided on a track guided vehicle and guided using inner surfaces of the left and right guide tracks. Branching rollers each comprising elevating and lowering means are provided in the right and left of the track guided vehicle and outside the right and left guide tracks. Thus, branching and rectilinear progression of the track guided vehicle is controlled by switching between a state where the branching rollers are elevated or lowered to guide the track guided vehicle using outer surfaces of the guide tracks and a state where the branching rollers do not contact with the outer surfaces.

Preferably, cam plates that can be rotatively moved are each provided with a spiral cam used to elevate and lower the corresponding one of the branching rollers via a cam follower. Further, each of the spiral cams is provided with at least two areas corresponding to positions where the corresponding one of the branching rollers is stopped, the areas having almost fixed radii of curvature from a center of rotative movement of the cam plate.

Further, preferably, the branching rollers are elevated or lowered in an area which is provided in a rectilinear progression section of the guide tracks and in which a gap is created between each of the branching rollers and the corresponding one of the guide tracks. Further, in a branching portion of the guide tracks, both the right or left branching rollers and the right or left guide rollers are abutted against the corresponding guide track. Moreover, the gap is formed by making the width of the guide track in the branching portion larger than that in the rectilinear progression section.

In the track guided vehicle system according to the present invention, whether the track guided vehicle runs straight or shifts to a branch course can be controlled by contacting one of the branching rollers with the outer surface of the corresponding guide track, which guides the guide rollers in the section (rectilinear progression section) different from the branching portion.

According to an aspect of the present invention, when the cam plate is rotatively moved, the cam follower, for example, reciprocates in accordance with the spiral cam. This elevates or lowers the corresponding branching roller. The spiral cam is provided with the areas having the almost fixed radii of curvature from the center of rotative movement of the cam plate. When the cam follower lies in one of these areas, the cam plate is stopped. Then, the height position of the branching roller measured when its elevation or lowering is stopped is almost fixed in spite of a small variation in the stopped position of the cam plate. Therefore, the height position of the branching roller can be precisely controlled.

According to another aspect of the present invention, branching or rectilinear progression is selected by elevating or lowering the branching rollers in the area in the rectilinear progression section in which a gap is created between each branching roller and the corresponding guide track. Thus, the elevation and lowering of the branching rollers does not interfere with the guide tracks. This eliminates the need to decelerate the track guided vehicle in front of the branching portion. Consequently, the branching rollers can be smoothly elevated and lowered. Further, in the branching portion, the track guided vehicle is supported by pressing the right or left branching rollers and right or left guide rollers against the outer and inner surfaces of the corresponding guide track so as to create substantially no gaps. Accordingly, even where running wheels are separated from a floor or ground surface, the track guided vehicle is not shaken or impacted. Therefore, the track guided vehicle can run at high speed regardless of whether it runs straight through or shifts to a branch line in the branching portion.

According to another aspect of the present invention, each of the guide tracks is wider in the branching portion so as to be tightly sandwiched between the corresponding branching rollers and guide rollers. On the other hand, each of the guide tracks is narrower in the rectilinear progression section so as to create a gap between the guide track and the corresponding branching rollers. In this manner, varying the width of the guide track enables each of the branching rollers to contact with the guide track or a gap to be created between them.

DETAILED DESCRIPTION OF THE PREFERRED EMBODIMENTS

Figure 1:
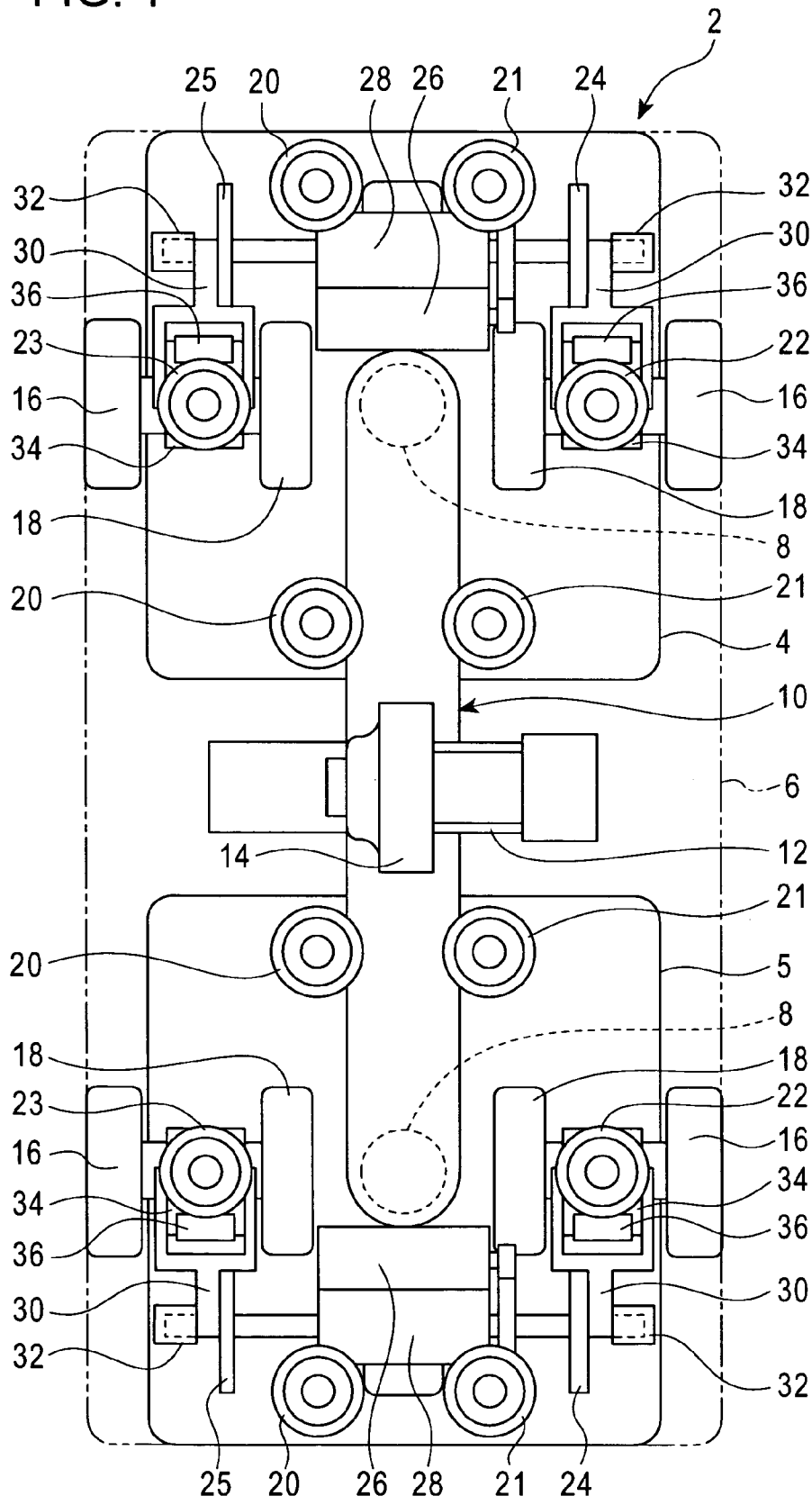
FIG. 1 is a plan view showing essential parts of bogies used in an embodiment and provided in the front and rear, respectively, of an overhead traveling vehicle.

In the figures, 2 is an overhead traveling vehicle, and 4, 5 are front and rear paired bogies. 6 is an overhead traveling vehicle main body. The overhead traveling vehicle main body 6 is supported at the bottom of the bogies 4, 5 using a front and rear shafts 8, 8. A frame 10 is provided so as to connect the front and rear shafts 8, 8 together. A drive wheel 14 is driven via a running motor 12 on the frame 10. The drive wheel 14 is pressed by urging means (not shown in the drawing) against a bottom surface of an upper part of a running track to allow the overhead traveling vehicle 2 to run.

Figure 3:
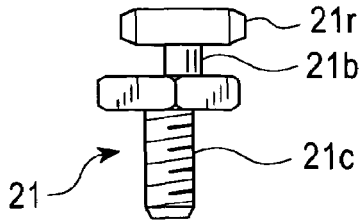
FIG. 3 is a side view of an eccentric roller used in the embodiment.

Each of the front and rear bogies 4, 5 is provided with free running wheels 16, 18 and runs using a top surface of a lower part of the running track as a tread. A total of four guide rollers 20, 21 including the front and rear guide rollers, and the right and left guide rollers are provided at the top of each of the bogies 4, 5, and the guide rollers 20, 21 are guided using inner guide surfaces of a guide track. The guide rollers 21 are eccentric rollers and their structure is shown in FIG. 3. The guide rollers 20 are typical free rollers. Further, paired branching rollers 22, 23 are provided near a central portion of each of the bogies 4, 5 and laterally outside the guide rollers 20, 21. The branching rollers 22, 23 are elevated and lowered using opposite phases.

24, 25 are a right and left cam plates driven by a common elevating and lowering motor 26 and a common brake 28. 30 is a pivoting arm and 32 is a pin acting as a pivoting center of the pivoting arm 30. Further, an elevating and lowering member 34 is mounted at one end of the pivoting arm 30. The elevating and lowering member 34 elevates and lowers together with the branching rollers 22, 23. 36 is an elevating and lowering guide that guides elevating and lowering motion of the elevating and lowering member 34, and the elevating and lowering guide 36 is, for example, a linear guide. 35 is a slot formed in the elevating and lowering member 34 and through which a pin or the like provided at the tip of the pivoting arm 30 is slid with respect to the elevating and lowering member 34.

A spiral cam groove 38 is formed around a rotative movement center 37 of each of the cam plates 24, 25, and a cam follower 40 provided at an end of the corresponding pivoting arm 30 is guided through the cam groove 38. The cams formed in the cam plates 24, 25 are not limited to groove-like ones but have only to be spiral so as to guide the cam followers. Further, the cam plates 24, 25 and the pivoting arms 30 are rotatively moved in a vertical plane to elevate and lower the branching rollers 22, 23. The cam groove 38 has, for example, three concentric areas having fixed radii of curvature from the rotative movement center 37. A low position area 42 has the smallest radius of curvature, and an intermediate position area 43 is located at a position obtained by rotatively moving the cam plates 24, 25 through, for example, 180 degrees. A high position area 44 is located at a position obtained by further rotatively moving the cam plates 24, 25 through, for example, 180 degrees.

Each of the low position area 42 and high position area 44 is present within a rotation angle (phase) of 45 degrees in each of the cam plates 24, 25. The cam groove 38 is concentric and it is concentric within a phase of, for example, 90 degrees in the intermediate position area 43. The cam plates 24, 25 can be rotatively moved through a little more than 360 degrees. Detected portions 45, 46 are provided on each of the cam plates 24, 25 so as to project from the other portions in a radial direction. A phase sensor 48 detects the detected portions 45, 46, and the phase sensor 48 detects, for example, edges of the detected portions 45, 46. Each edge is located at an almost central portion of the concentric part of the area 42, 43, 44. That is, the phase sensor 48 uses the edges of the detected portions 45, 46 to detect when the cam follower 40 has reached almost the center of the area 42, 43, 44.

The lateral paired cam plates 24, 25 are rotatively moved by the elevating and lowering motor 26, and are stopped by the brake 28. The layout of the cam groove 38 differs between the cam plates 24, 25 so that when one of the cam followers 40 is in the high position area 44 in the cam plate 24 side, the other cam follower 40 is in the low position area 42 in the cam plate 25 side. The intermediate position area 43 is set to have the same phase in the right and left cam plates 24, 25. Then, a control section 49 controls the elevating and lowering motor 26, and the brake 28 in accordance with a signal from the phase sensor 48 to control the heights of the branching rollers 22, 23. However, a mechanism for elevating and lowering the branching rollers 22, 23 is arbitrary.

FIG. 3 shows an example of the guide roller 21. 21*r* is an eccentric roller consisting of a free roller. A shaft 21*b* of the eccentric roller 21*r* is eccentric to the axis of a mounting portion 21*c*. Rotating a threaded portion of the mounting portion 21*c* enables the distance between the lateral paired guide rollers to be adjusted at the site. The branching roller located closer to the eccentric rollers, for example, in this case, the branching roller 22 preferably has its lateral position freely adjusted as an eccentric roller.

Figure 2:
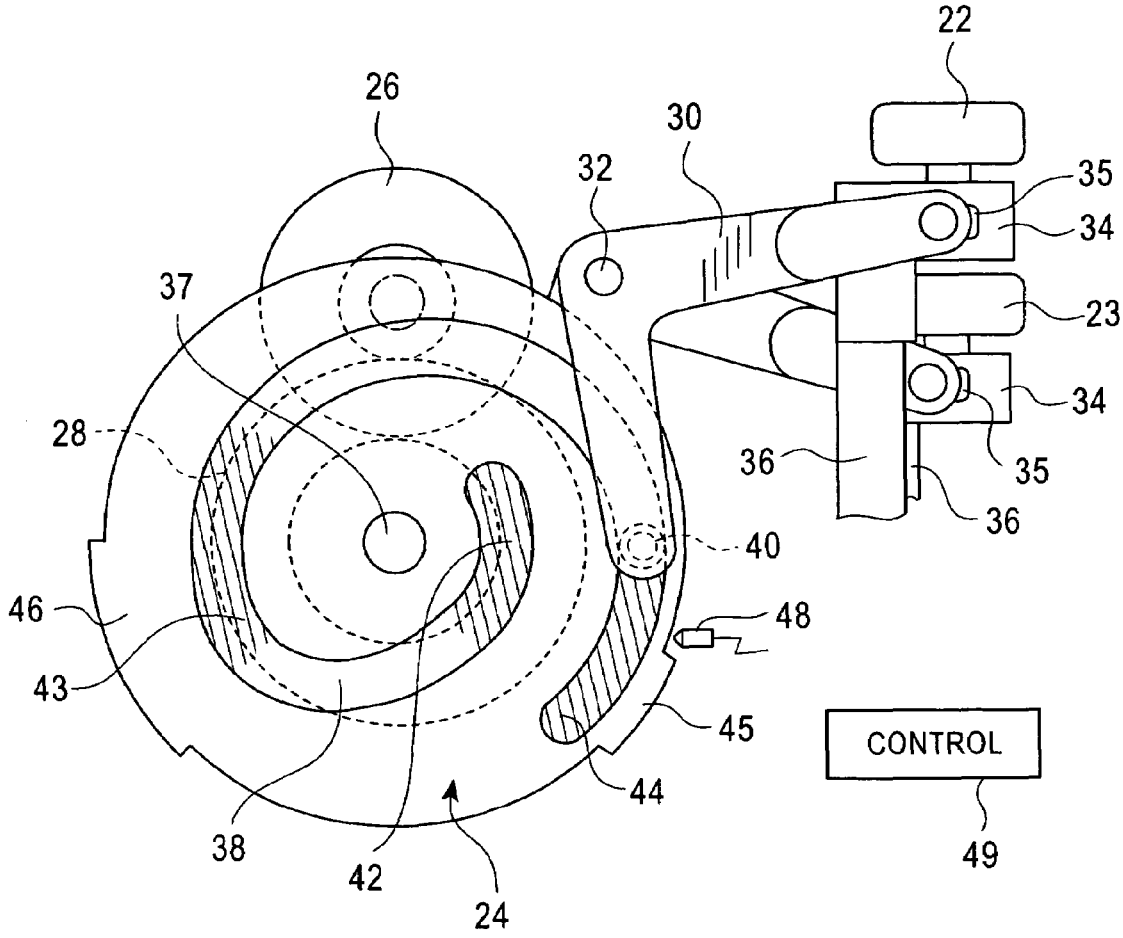
FIG. 2 is a side view showing an essential part of an elevating and lowering mechanism on the overhead traveling vehicle which mechanism is used in the embodiment.

With reference to FIGS. 4 to 12, a description will be given of the configuration of a running track 50 and operations of the overhead traveling vehicle in the branching portion. The members of the system may be denoted by the same reference numerals as those used in FIGS. 1 to 3 though the numerals are not used in FIGS. 4 to 12.

51 is a branching portion of the running track 50, and 52 is a rectilinear progression section (this means that this section has no branch or mergence). A right and left treads 53, 53 are provided on a top surface of a lower part of the box-like running track 50 to support running wheels 16, 18. Further, an opening 54 is formed between the treads 53, 53 so that the shafts 8, used to connect the bogies 4, 5 together, can pass through the opening 54. Furthermore, guide track 56 projecting downward in the vertical direction are provided on the right and left sides, respectively, of a bottom surface of an upper part of the running track 50. The width of the guide track 56 is set to vary between the rectilinear progression section 52 and the branching portion 51. The guide track 56 in the branching portion 51 is formed as a wider portion 58 that is wider than the guide track 56 in the rectilinear progression section 52 by, for example, about 1 mm outward in the lateral direction (wider on the side of the guide track 56 with which the branching rollers 22, 23 contact).

As a result, in the rectilinear progression section 52, a gap of, for example, about 1 mm is created between the guide track 56 and the branching rollers 22, 23. In the wider portion 58 in the branching portion 51, there is no lateral gap between an outer surface of the guide track 56 and the branching rollers 22, 23. Further, the spacing between the right and left guide tracks 56, 56 is fixed in the rectilinear progression section 52 and in the branching portion 51. Since each eccentric guide roller 21 is used to adjust the spacing between the guide rollers 20, 21 at the time of installation or the like, the guide rollers 20, 21 are in tight contact with inner surfaces of the guide tracks 56, 56.

Figure 4:
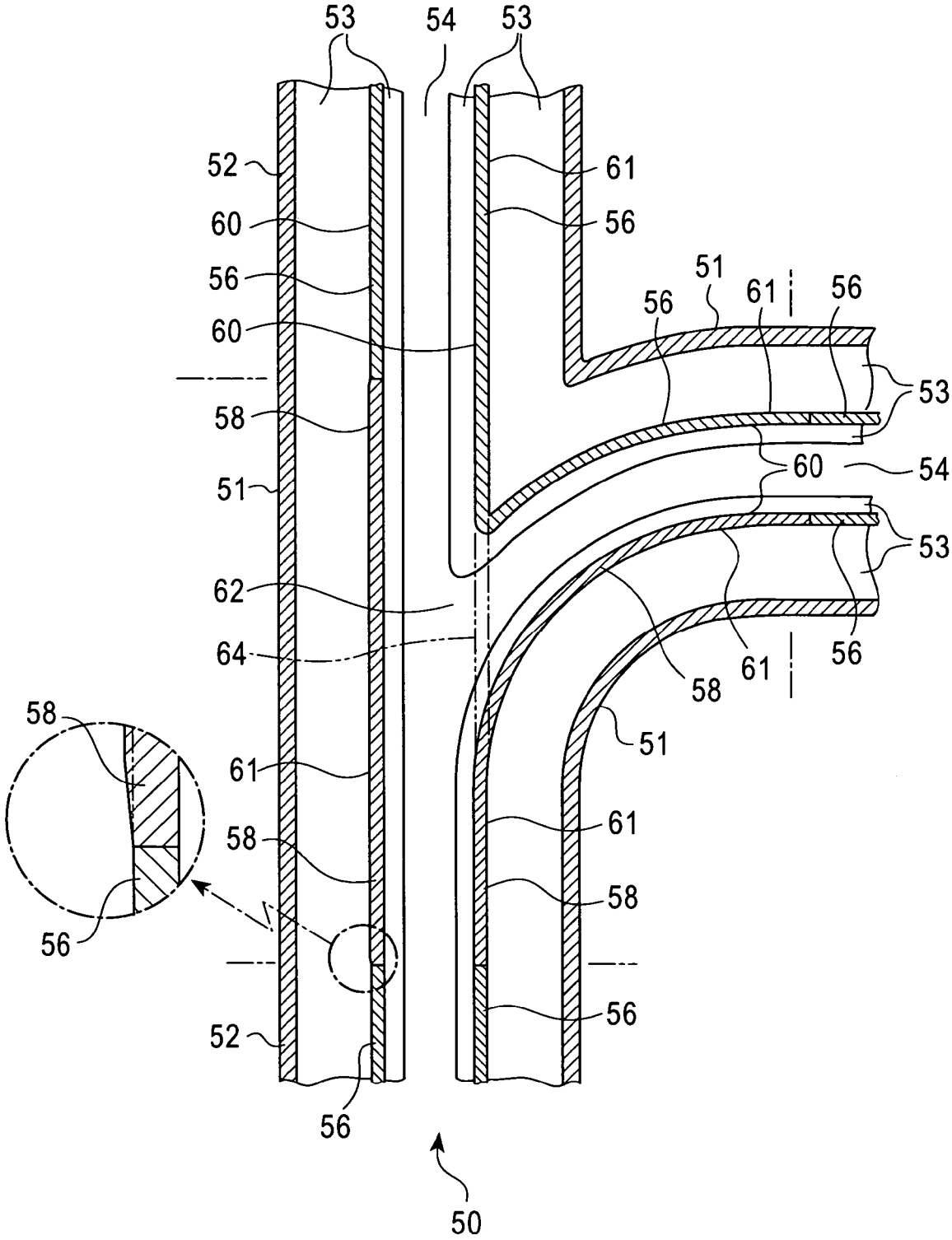
FIG. 4 is a horizontal sectional view showing a horizontal track in a branching portion, in an overhead traveling vehicle system according to the embodiment.

In the layout of the running track 50, running upward in FIG. 4 corresponds to rectilinear progression, and running upward and rightward in FIG. 4 corresponds to branching. On the left side of the opening 54, the guide track 56 and its wider portion 58 are arranged so as not to create any gap between them. The guide track 56 and its wider portion 58 are also arranged on the right side of the opening 54 except for a cut portion 64. There is a Y-shaped portion 62 in the branching portion 51 in which the opening 54 is Y-shaped.

Figure 5:
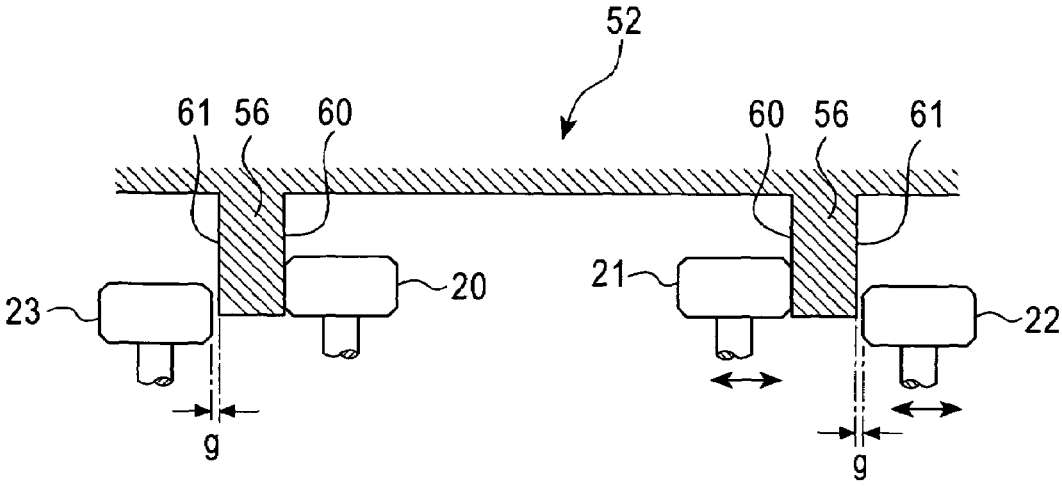
FIG. 5 is a diagram showing how guide rollers and branching rollers are positioned relative to a guide track in a rectilinear progression section.

FIG. 5 shows how the guide rollers 20, 21 and the branching rollers 22, 23 are positioned relative to the guide track 56 in the rectilinear progression section 52. An inner surface of each of the guide tracks 56, 56 constitutes a guide surface 60, and an outer surface of the guide track 56 constitutes a guide surface 61. In the wider portion 58, the guide surface 61 is shifted outward of the guide track 56 by about 1 mm. In the rectilinear progression section 52, the branching rollers 22, 23 are at, for example, the height of the intermediate position. There is a gap (g) between the guide surface 61 and the branching rollers 22, 23. Accordingly, the branching rollers 22, 23 can elevate and lower without interfering with the guide track 56. In the rectilinear progression section 52, the left and right guide rollers 20, 21 contact tightly with the left and right guide surfaces 60, 60, respectively, to guide the overhead traveling vehicle 2.

Figure 6:
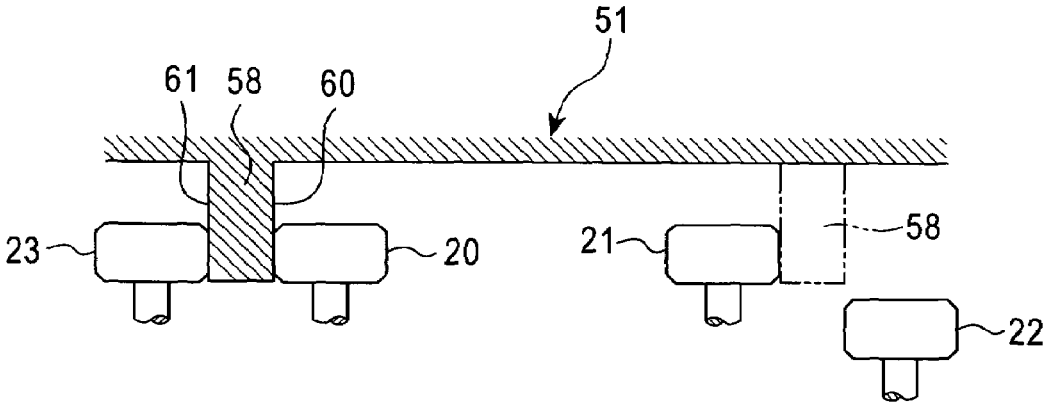
FIG. 6 is a diagram showing how the guide rollers and the branching rollers are positioned relative to the guide track when the vehicle runs straight through a branching portion.

If the track guided vehicle runs straight through the branching portion 51, the branching rollers 23 are at the high position, while the branching rollers 22 are at the low position, as shown in FIG. 6. In the Y-shaped portion 62 in FIG. 4, neither the guide rollers 21 nor the branching rollers 23 contact with the guide track 56, while the guide rollers 20 and the branching rollers 23 contact tightly with the guide surfaces 60, 61 of the wider portion 58, respectively. Consequently, the postures of the bogies are maintained.

Figure 7:
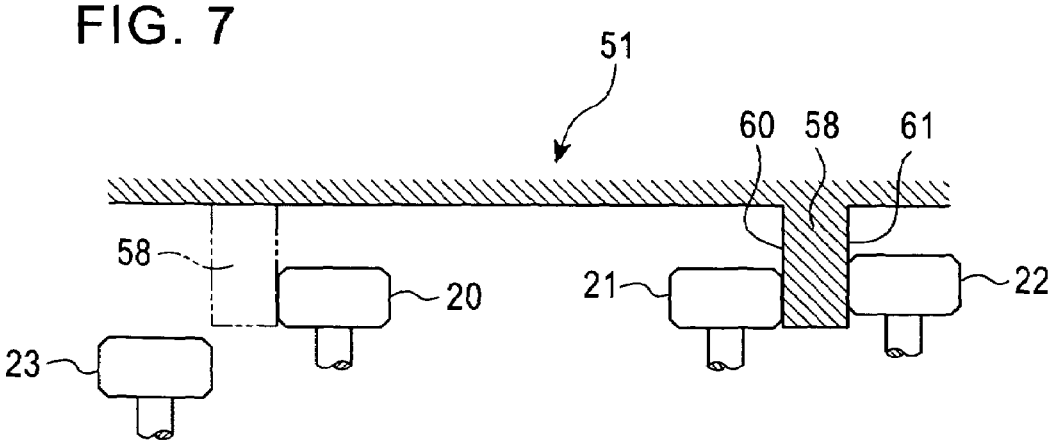
FIG. 7 is a diagram showing how the guide rollers and the branching rollers are positioned relative to the guide track when the vehicle shifts to a branch line in the branching portion.

If the track guided vehicle shifts to a branch line in the branching portion 51, the branching rollers 22 are at the high position, while the branching rollers 23 are at the low position, as shown in FIG. 7. In the Y-shaped portion 62 in FIG. 4, neither the guide rollers 20 nor the branching rollers 23 contact with the guide track 56, while the guide rollers 21 and the branching rollers 22 contact tightly with the guide surfaces 60, 61 of the wider portion 58, respectively. Consequently, the postures of the bogies 4, 5 are maintained.

Figure 8:
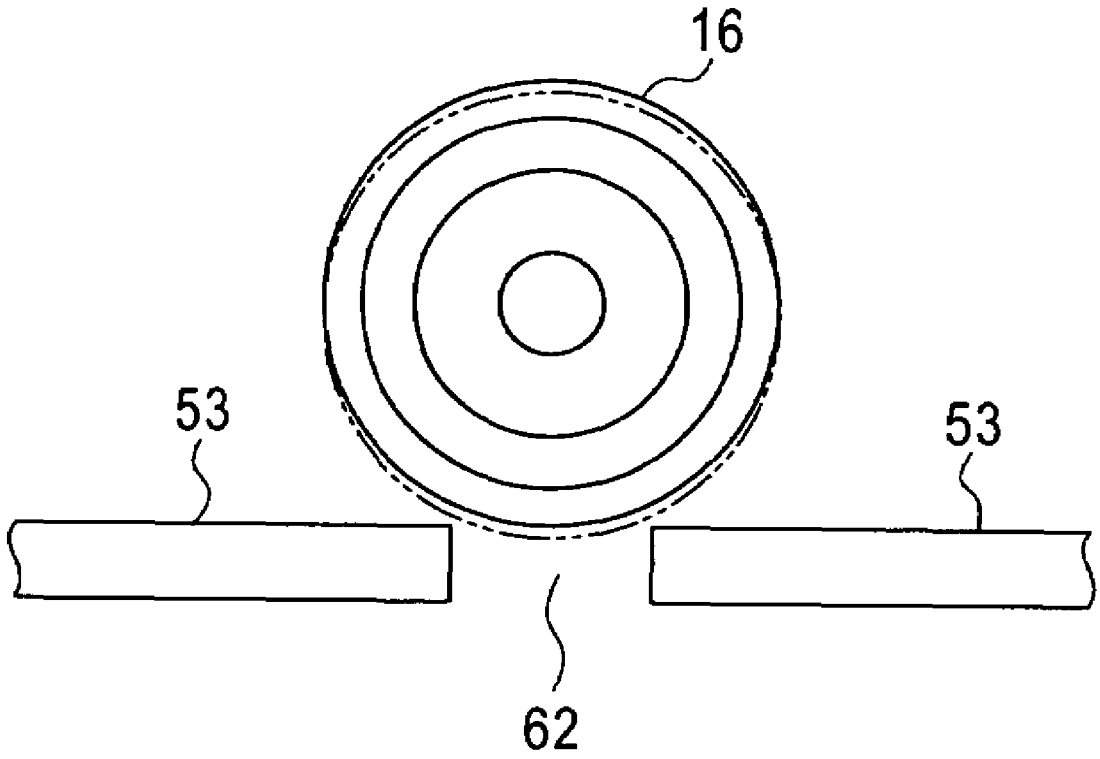
FIG. 8 is a diagram schematically showing how running wheels pass over a cut portion of a tread.

A solid line in FIG. 8 shows how the running wheels 16 and others operate when the track guided vehicle passes through the Y-shaped portion 62. When separated from the tread 53, the running wheels 16 and others sink slightly to shake the bogies 4, 5. However, in the embodiment, the wider portion 58 is tightly sandwiched between the rollers 20, 23 or the rollers 21, 22. This prevents the bogies 4, 5 from being shaken.

Figure 9:
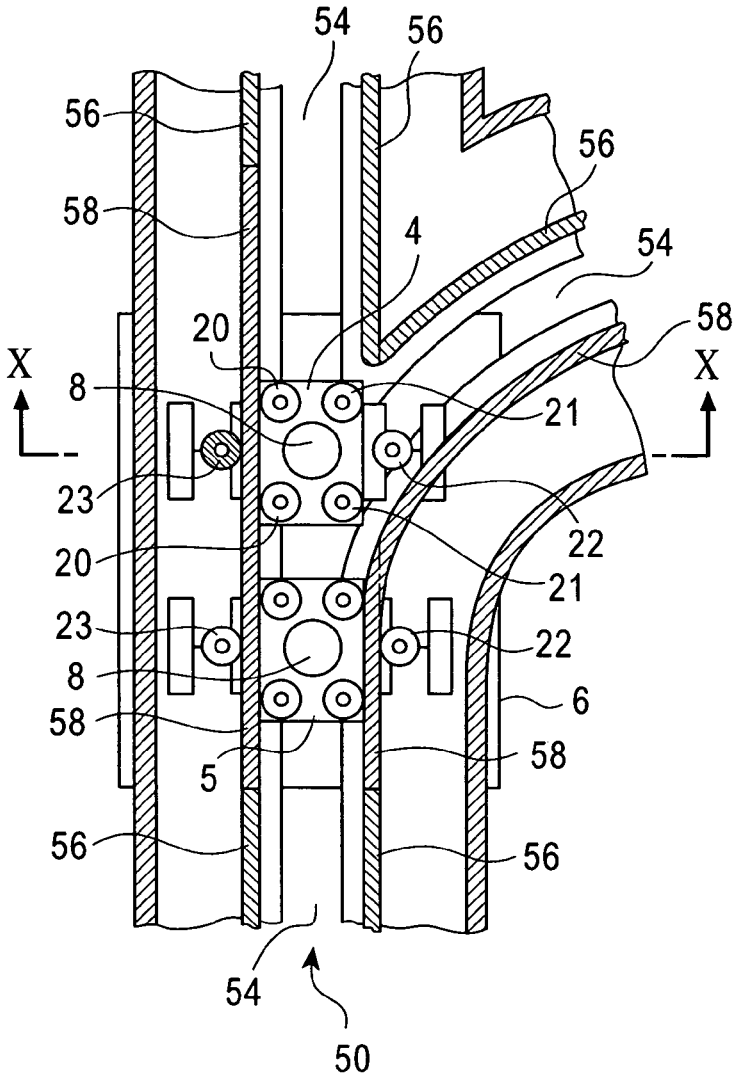
FIG. 9 is a diagram schematically showing how the overhead traveling vehicle runs straight through the branching portion in FIG. 4.
Figure 10:
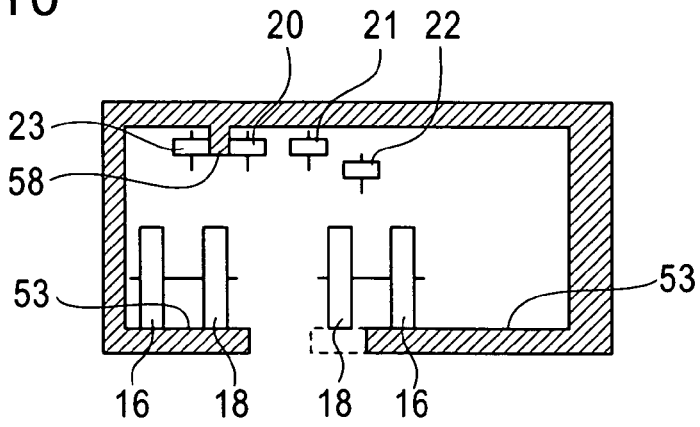
FIG. 10 is a sectional view taken along a line X-X in FIG. 9 and schematically showing how the guide rollers, the branching rollers, and the running wheels are arranged in the running track during rectilinear progression.

FIGS. 9 and 10 show operations during rectilinear progression. In the figures, the branching rollers 23 are at the high position, while the branching rollers 22 are at the low position. The right-hand branching rollers 22 do not contact with the guide track 56, while the wider portion 58 of the guide track 56 is sandwiched between the left-hand branching rollers 23 and the guide rollers 20. This selects rectilinear progression. For rectilinear progression, the branching rollers 22, 23 are elevated or lowered in a part of the rectilinear progression section 52 which lies in front of the branching portion 51. In this case, the elevation and lowering of the branching rollers 22, 23 does not interfere with the guide track 56. Therefore, the track guided vehicle can run straight through the branching portion 51 at high speed.

Figure 11:
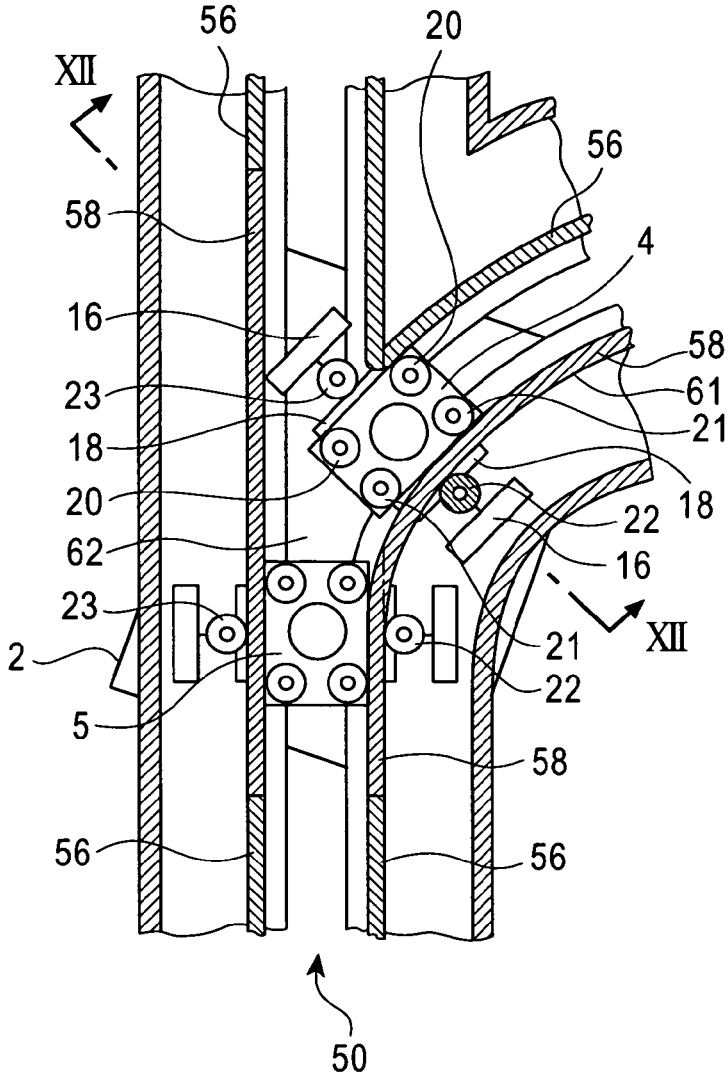
FIG. 11 is a diagram showing how the overhead traveling vehicle shifts to a branch line in the branching portion shown in FIG. 4.
Figure 12:
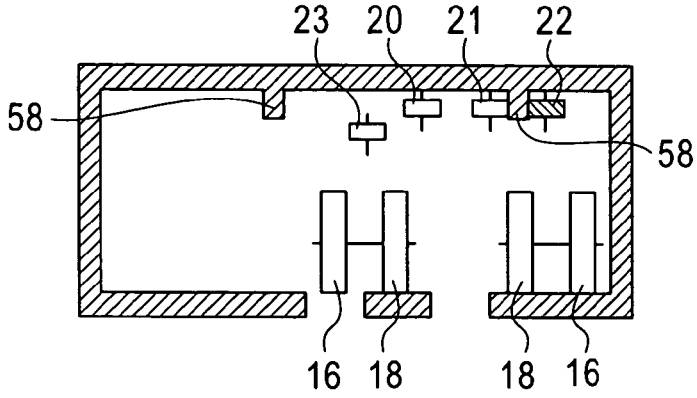
FIG. 12 is a sectional view taken along a line XII-XII in FIG. 11 and schematically showing how the guide rollers, the branching rollers, and the running wheels are arranged in the running track during branching.

FIGS. 11 and 12 show the conditions during branching. In this case, the branching rollers 22 are at the high position. The wider portion 58 is sandwiched between the branching rollers 22 and the guide rollers 21. The left-hand branching rollers 23 are at the low position and pass below the guide track 56. For branching, the branching rollers 22, 23 are elevated or lowered in a part of the rectilinear progression section 52 which lies in front of the branching portion 51. Therefore, the track guided vehicle can shift to the branch line at high speed.

In the embodiment, the guide track 56 is narrower than the wider portion 58 all along the rectilinear progression section 52. However, the guide track 56 may be formed to be narrower only in a predetermined area in front of the branching portion 51. Further, if a merging portion is provided instead of the branching portion 51, the track guided vehicle may be run upward in FIG. 4. In this case, when the track guided vehicle runs downward in FIG. 4, the branching rollers 22, 23 and others are operated as described in FIG. 9. When the track guided vehicle runs downward and leftward in FIG. 4, the branching rollers 22, 23 and others are operated as described in FIG. 11. In the embodiment, the branching rollers 22, 23 are switched between the three height positions. However, the branching rollers 22, 23 may be switched between two height positions for branching and rectilinear progression. For example, the track guided vehicle may in principle run straight in the rectilinear progression section 52, and if the vehicle is to shift to a branch line, the branching rollers 22, 23 may be switched to the corresponding height position in front of the branching portion 51.

In the embodiment, the longitudinal paired guide rollers 20 and the longitudinal paired guide rollers 21 are provided on each bogie. Each branching roller is placed at the intermediate position of the bogie in its longitudinal direction. However, conversely, the longitudinal paired branching rollers may be provided on each bogie, with the guide rollers each provided at the intermediate position of the bogie in its longitudinal direction. In this case, the four branching rollers and the two guide rollers are provided on each bogie.

The overhead traveling vehicle is shown in the embodiment. However, the present invention is applicable to a track guide vehicle that runs along a running track laid on the ground. Further, in the case of the overhead traveling vehicle, an opening may be formed at the top of the running track, with a carriage placed over the opening. In this case, the guide tracks are provided on the bottom surface of the upper part of the running track and on the right and left sides, respectively, of the opening.

The embodiment produces the following effects:

(1) Whether the track guided vehicle runs straight or shifts to a branch line, it can run stably through the branching portion at high speed.

(2) The track guided vehicle need not be decelerated in order to allow the branching rollers to be elevated or lowered to select branching or rectilinear progression.

(3) By increasing the width of each guide track in the branching portion outward in the lateral direction, it is possible to allow the branching rollers to contact tightly with the guide track only in the branching portion, while avoiding contacting with the guide track in the rectilinear progression section.

(4) The spacing between the guide rollers can be adjusted at the site so as to contact the right and left guide rollers tightly with the inner surfaces of the guide tracks.

The invention claimed is:

1. A track guided vehicle system comprising:

a track guided vehicle, left and right guide tracks projecting in a vertical direction at a right and left of a running track, left and right guide rollers on the track guided vehicle which contact inner surfaces of the left and right guide tracks, branching rollers at the right and left of the track guided vehicle, each comprising elevating and lowering means, the branching rollers being positioned outside the right and left guide tracks, and cam plates that can be rotatively moved, each provided with a cam used to elevate and lower the corresponding one of the branching rollers via a cam follower, wherein branching and rectilinear progression of the track guided vehicle is controlled by switching between a state where the branching rollers are elevated to guide the track guided vehicle using outer surfaces of the guide tracks and lowered to a state where the branching rollers do not contact the outer surfaces of said guide tracks.

2. A track guided vehicle system according to claim 1, wherein each of the cams is provided with at least two areas corresponding to positions where the corresponding one of the branching rollers is stopped, the areas having almost fixed radii of curvature from a center of rotative movement of the cam plate.

3. A track guided vehicle system according to claim 1, wherein the branching rollers are elevated or lowered in an area which is provided in a rectilinear progression section of the guide tracks, wherein a gap is created between each of the branching rollers and the corresponding one of the guide tracks, and wherein in a branching portion of the guide tracks, both the right or left branching rollers and the right or left guide rollers are abutted against the corresponding guide track.

4. A track guided vehicle system according to claim 3, wherein the gap is formed by making a width of the guide track in the branching portion larger than a width of the guide track in the rectilinear progression section.

* * * * *